US008405831B2

(12) United States Patent
Carlson et al.

(10) Patent No.: US 8,405,831 B2
(45) Date of Patent: Mar. 26, 2013

(54) SYSTEMS AND METHODS FOR INDICATING THE POSITION OF A WEB

(75) Inventors: Daniel H. Carlson, Arden Hills, MN (US); Dale L. Ehnes, Cotati, CA (US); Daniel S. Wertz, Sebastopol, CA (US); Luis A. Aguirre, Austin, TX (US); Levent Biyikli, Cedar Park, TX (US); Alan B. Campbell, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 556 days.

(21) Appl. No.: 12/664,523

(22) PCT Filed: Jun. 18, 2008

(86) PCT No.: PCT/US2008/067375

§ 371 (c)(1),
(2), (4) Date: Dec. 14, 2009

(87) PCT Pub. No.: WO2008/157623

PCT Pub. Date: Dec. 24, 2008

(65) Prior Publication Data

US 2010/0187277 A1 Jul. 29, 2010

Related U.S. Application Data

(60) Provisional application No. 60/944,882, filed on Jun. 19, 2007.

(51) Int. Cl.

| | |
|---|---|
| ***G01N 21/86*** | (2006.01) |
| ***G01N 21/55*** | (2006.01) |
| ***G01B 11/02*** | (2006.01) |

(52) U.S. Cl. ..... 356/429; 356/430; 356/431; 356/239.1; 356/239.2

(58) Field of Classification Search ..... 356/429–431, 356/238.1–238.3, 239.1–239.2; 250/559.07, 250/559.29, 559.36, 559.44; 427/359
See application file for complete search history.

(56) References Cited

U.S. PATENT DOCUMENTS

| | | | | |
|---|---|---|---|---|
| 1,898,723 | A | 2/1933 | Fuller | |
| 3,570,735 | A | 3/1971 | Kurz | |
| 3,615,048 | A | 10/1971 | Martin | |
| 3,667,031 | A | 5/1972 | Cox, Jr. et al. | |
| 4,010,463 | A | 3/1977 | Kay | |
| 4,049,213 | A | 9/1977 | Hank et al. | |
| 4,274,748 | A * | 6/1981 | Burtin et al. | 356/431 |

(Continued)

FOREIGN PATENT DOCUMENTS

| | | |
|---|---|---|
| CN | 2447719 | 9/2001 |
| DE | 197 54 776 | 6/1999 |

(Continued)

OTHER PUBLICATIONS

U.S. Appl. No. 60/884,494, filed Jan. 11, 2007, entitled "Web Longitudinal Position Sensor".

(Continued)

*Primary Examiner* — Sang Nguyen
(74) *Attorney, Agent, or Firm* — Steven E. Skolnick; Scott A. Baum

(57) ABSTRACT

Methods and systems for indicating the displacement of a flexible web are described. An elongated, flexible web includes an integral scale having scale features configured to modulate energy directed towards the web. A transport mechanism provides relative movement between the web relative to a transducer. The transducer detects energy modulated by the scale features and generates a signal indicting a continuous web displacement based on the modulated energy.

29 Claims, 8 Drawing Sheets

U.S. PATENT DOCUMENTS

| | | | | |
|---|---|---|---|---|
| 4,284,221 | A * | 8/1981 | Nagel et al. | 225/100 |
| 4,401,893 | A * | 8/1983 | Dehuysser | 250/559.49 |
| 4,529,922 | A | 7/1985 | Ono | |
| 4,532,430 | A | 7/1985 | Ross | |
| 4,610,739 | A * | 9/1986 | Jensen | 156/64 |
| 4,618,518 | A * | 10/1986 | Pricone et al. | 428/41.5 |
| 4,697,485 | A | 10/1987 | Raney | |
| 4,893,135 | A * | 1/1990 | Jamzadeh | 347/248 |
| 4,945,252 | A | 7/1990 | Lerner et al. | |
| 5,047,651 | A * | 9/1991 | Wessner et al. | 250/548 |
| 5,355,154 | A | 10/1994 | Guerin | |
| 5,450,116 | A | 9/1995 | Weiselfish | |
| 5,667,123 | A | 9/1997 | Fukuda | |
| 5,768,776 | A | 6/1998 | Pendse | |
| 5,778,724 | A * | 7/1998 | Clapp et al. | 73/159 |
| 5,859,707 | A | 1/1999 | Nakagawa | |
| 5,870,204 | A * | 2/1999 | Chiu et al. | 356/430 |
| 5,931,097 | A | 8/1999 | Neifert | |
| 6,056,180 | A * | 5/2000 | Crowley et al. | 226/31 |
| 6,087,655 | A | 7/2000 | Kobrin | |
| 6,164,201 | A | 12/2000 | Burke | |
| 6,273,313 | B1 | 8/2001 | Noll et al. | |
| 6,375,870 | B1 | 4/2002 | Visovsky | |
| 6,396,073 | B1 * | 5/2002 | Taylor | 250/559.42 |
| 6,495,214 | B1 | 12/2002 | Nentwich et al. | |
| 6,505,906 | B1 | 1/2003 | Bland et al. | |
| 6,521,905 | B1 * | 2/2003 | Luxem et al. | 250/559.09 |
| 6,647,128 | B1 | 11/2003 | Rhoads | |
| 7,121,496 | B2 * | 10/2006 | Jackson | 242/563.1 |
| 7,174,237 | B2 * | 2/2007 | Takayama et al. | 700/230 |
| 7,296,717 | B2 | 11/2007 | Swanson et al. | |
| 7,526,230 | B2 * | 4/2009 | Kudo et al. | 399/167 |
| 7,560,718 | B2 * | 7/2009 | Wittmann et al. | 250/559.07 |
| 7,826,041 | B2 * | 11/2010 | Takeda | 356/71 |
| 2002/0018220 | A1 | 2/2002 | Aoki | |
| 2002/0121131 | A1 | 9/2002 | Mancevski | |
| 2002/0122186 | A1 | 9/2002 | Igaki | |
| 2003/0218125 | A1 | 11/2003 | Igaki | |
| 2004/0022557 | A1 | 2/2004 | Kudo | |
| 2004/0197443 | A1 | 10/2004 | Scarabelli et al. | |
| 2004/0227644 | A1 | 11/2004 | Lin | |
| 2004/0240513 | A1 | 12/2004 | del Puerto | |
| 2004/0262505 | A1 | 12/2004 | Atsuta | |
| 2005/0218237 | A1 | 10/2005 | Lapstun | |
| 2005/0232475 | A1 | 10/2005 | Floeder et al. | |
| 2005/0263689 | A1 | 12/2005 | Atsuta | |
| 2005/0274880 | A1 | 12/2005 | Atsuta | |
| 2006/0174992 | A1 | 8/2006 | Brost et al. | |
| 2006/0210714 | A1 | 9/2006 | Huizinga et al. | |
| 2007/0099396 | A1 | 5/2007 | Hirai | |
| 2007/0138153 | A1 | 6/2007 | Redman | |
| 2008/0039718 | A1 | 2/2008 | Drinan | |
| 2008/0073493 | A1 | 3/2008 | Atsuta | |

FOREIGN PATENT DOCUMENTS

| | | | |
|---|---|---|---|
| EP | 0 838 665 | A1 | 4/1998 |
| EP | 1 235 054 | A2 | 8/2002 |
| EP | 1 722 201 | A2 | 11/2006 |
| GB | 2 065 871 | | 7/1981 |
| GB | 2 195 179 | A | 3/1988 |
| JP | 62-111860 | | 5/1987 |
| JP | 02-037963 | | 8/1990 |
| JP | 05-010725 | | 1/1993 |
| JP | 11-167165 | A | 6/1999 |
| JP | 2005-178962 | | 7/2005 |
| WO | WO 2005/106104 | | 11/2005 |
| WO | WO 2006/107057 | A1 | 10/2006 |
| WO | WO 2007/027757 | | 3/2007 |

OTHER PUBLICATIONS

U.S. Appl. No. 60/944,888, filed Jun. 19, 2007 entitled "Total Internal Reflection Displacement Scale".

U.S. Appl. No. 60/944,890, filed Jun. 19, 2007 entitled "Systems and Methods for Fabricating Displacement Scales".

U.S. Appl. No. 61/141,128, filed Dec. 29, 2008, entitled "Phase-locked Web Position Signal Using Web Fiducials".

U.S. Appl. No. 61/141,308, filed Dec. 30, 2008, entitled "Apparatus and Method for Making Fiducials on a Substrate".

* cited by examiner

SYSTEMS AND METHODS FOR INDICATING THE POSITION OF A WEB

PRIORITY

This application claims priority to U.S. Provisional Application No. 60/944,882, entitled "SYSTEMS AND METHODS FOR INDICATING THE POSITION OF A WEB", filed on Jun. 19, 2007, the disclosure of which is incorporated herein by reference.

TECHNICAL FIELD

The present disclosure is related to methods and systems for indicating the position of a flexible, elongated web.

BACKGROUND

Fabrication of many articles, including flexible electronic or optical components, involves alignment between layers of material deposited or formed on an elongated substrate or web. The formation of the material layers on the web may occur in a continuous process or a step and repeat process involving multiple steps. For example, patterns of material may be deposited in layers on an elongated web through multiple deposition steps to form layered electronic or optical devices. Some layered articles require precise alignment of features that are applied on one or both sides of the web.

To achieve alignment between the layers, lateral crossweb positioning and longitudinal downweb positioning must be maintained as the web moves through multiple manufacturing steps. Maintaining alignment between layers formed on the web becomes more complex when the web is flexible or stretchable.

SUMMARY

Embodiments of the present disclosure involve methods and systems for indicating the position of a flexible, elongated web. One embodiment is directed to a method for indicating web position. A moving, flexible web includes a plurality of discrete scale features disposed on the web. An energy field, such as a magnetic, electric or electromagnetic field is modulated using the scale features. The modulated energy is converted into a signal that provides for continuous measurement of web displacement. For example, the signal may be used to provide for continuous measurement of one or more translational and/or rotational degrees of freedom of the web, including continuous longitudinal displacement, continuous lateral displacement, and/or angular rotation of the web. The signal may be used to determine web position, to control web movement, and/or to measure other parameters of the web or ambient environment such as temperature, modulus of elasticity of the web, and/or web strain.

According to some aspects of the disclosure, the scale features may comprise optical scale features used to modulate light directed toward the web. The web may or may not be transparent. For a transparent web, one implementation involves detecting light transmitted through the transparent web. The web displacement is indicated based on the transmitted light. Alternatively, the web displacement may be indicated based on reflected light. One or more scanning reticles can be used to provide modulation of the light in addition to the modulation provided by the optical scale features.

Another embodiment of the disclosure involves a system for indicating web position. The system includes an elongated, flexible web having an integral scale disposed on the web. The scale comprises scale features configured to modulate energy directed towards the web. A transport mechanism is configured to provide relative movement between the web and a transducer. The transducer detects the energy modulated by the scale features and generates a signal indicting a continuous web displacement based on the modulated energy. The system may also include a processor that determines the displacement of the web and/or web position based on the signal generated by the transducer. The system may also include a web motion controller that controls the movement of the web based on the indicated position.

In certain embodiments, the scale features comprise optical features configured to modulate light directed toward the web. One or more scanning reticles may be included that further modulate the light.

Operating in a transmissive mode, the scale modulates light by allowing a portion of light directed toward a transparent web to be transmitted through the web. The transducer detects the transmitted light and generates a signal indicating web displacement based on the transmitted light. Operating in a reflective mode, the scale modulates light by reflecting a portion of the light towards the transducer. The transducer detects the reflected light and generates a signal indicating web displacement based on the reflected light.

Another embodiment of the disclosure is directed to an apparatus comprising a flexible, elongated web having an integral scale. The scale comprises a pattern of scale features disposed on the web that are configured to modulate energy directed toward the web. The scale features may be optical prisms configured to reflect light via total internal reflection. The modulated energy provides for a continuous indication of the longitudinal and/or lateral displacement of the web and/or the angular rotation of the web. In certain embodiments, the modulated energy may be used to control the web movement and/or to measure other parameters of the web or ambient environment such as temperature, modulus of elasticity of the web, and/or web strain.

In addition to the scale features disposed on the web, the web may also include a pattern of web features. The bend radius of the flexible web may be less than about 100 mm, less than about 50 mm, less than about 25 mm, or even less than about 5 mm, for example.

The above summary of the present disclosure is not intended to describe each embodiment or every implementation of the present disclosure. Advantages and attainments, together with a more complete understanding of the disclosure, will become apparent and appreciated by referring to the following detailed description and claims taken in conjunction with the accompanying drawings.

DETAILED DESCRIPTION

Figure 1:
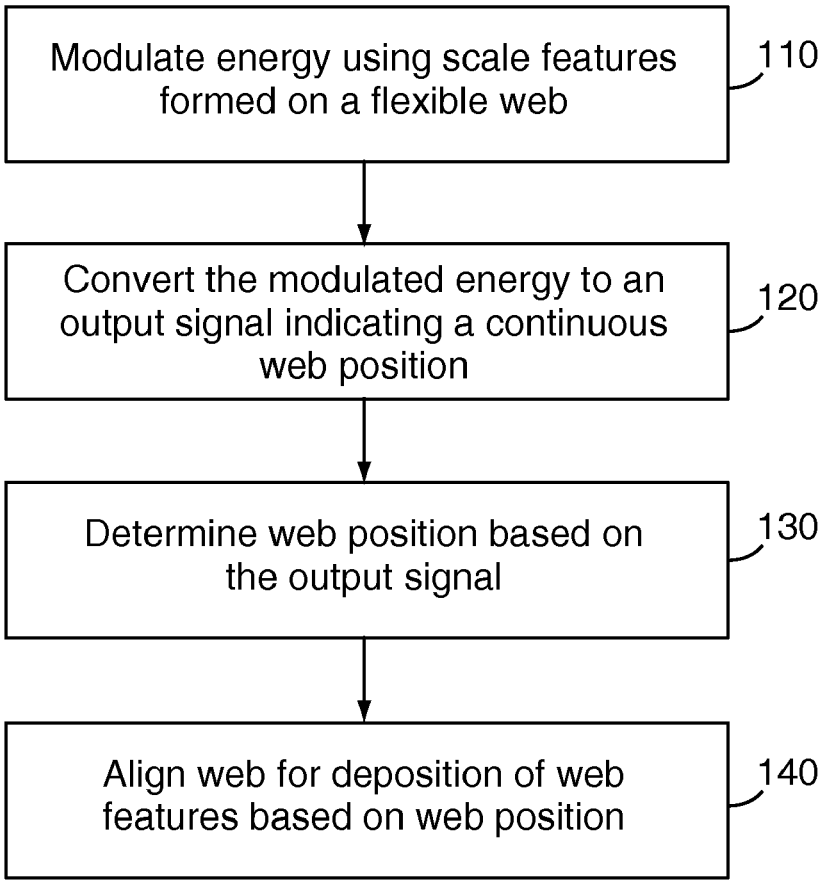
FIG. 1 is a flow diagram illustrating a method for determining web displacement and for alignment of a web in accordance with embodiments of the disclosure.

There is a need for enhanced methods and systems for indicating the position of a web used as a substrate in a manufacturing process. The present disclosure fulfills these and other needs, and offers other advantages over the prior art.

In the following description of the illustrated embodiments, reference is made to the accompanying drawings which form a part hereof, and in which is shown by way of illustration, various embodiments in which the disclosure may be practiced. It is to be understood that the embodiments may be utilized and structural changes may be made without departing from the scope of the present disclosure.

Embodiments of the present disclosure illustrate methods and systems that may be used to indicate web displacement, determine web position, and/or control the movement of a flexible web using a scale integrally formed or disposed on the web. The scale includes a plurality of scale features that modulate energy to indicate web displacement. For example, the scale features may modulate the energy of an electric field, a magnetic field, or an electromagnetic field. In various embodiments, the scale features may modulate the energy of an electromagnetic field (i.e., light) where the modulated energy is sensed by a photosensor. In alternative embodiments, the scale features may modulate the energy of an electric field, e.g., the electric field energy sensed by a capacitive sensor, and/or may modulate the energy of a magnetic field, e.g., the magnetic field energy sensed by an inductive sensor.

Indication of continuous web translational and/or rotational displacement using the integral scale may be employed to determine web position and to control movement of the flexible web during deposition of pattern features on the web in one or a number of successive manufacturing steps. For example, the scale described in connection with the embodiments of the disclosure provided herein may be used to indicate continuous web displacement. The indication of web displacement facilitates alignment between multiple layers of pattern features deposited or otherwise formed on a web during a roll-to-roll manufacturing process. The scale described herein is particularly useful for manufacture of flexible, multi-layer electronic or optical devices that require multiple deposition steps to form successive layers of pattern features on a flexible web.

The approaches described herein may be used to automatically compensate for changes in web strain that commonly occur in web processing applications. Certain manufacturing processes may cause transient or permanent changes in the web such that the web is permanently deformed, such as deformation caused by stretching or shrinking of the web. Embodiments of the present disclosure advantageously offer compensation for transient or permanent changes in the web. For example, in some embodiments, the scale features are deposited on the web substantially concurrently with a layer of web pattern features, such as the first layer of web pattern features used to form multi-layer electronic or optoelectronic devices. As the scale features and the web pattern features are deposited, the pattern features deposited on the web and the scale features experience the same amount of web strain. The scale features may be used to accurately track the lateral position, longitudinal position, and/or angular rotation of the first layer web pattern features, regardless of the amount of web strain in subsequent processes. As web strain is increased (i.e. the web is stretched more) the scale features are stretched along with the corresponding web pattern features formed on the web. This phenomenon allows signals produced by the scale features to be used to more accurately track the position of web features deposited on the web.

Using the scale described in accordance with various embodiments herein, accurate alignment with the concurrently deposited web pattern features can be achieved even when the web is stretched. Maintaining alignment between layers formed on the web becomes more complex when the web is flexible or stretchable. In particular, the approaches of the present disclosure are particularly useful in that they allow replication of the scale features on plastic webs or other flexible webs, as opposed to rigid substrates such as glass. For example, a flexible web having a scale disposed thereon in accordance with embodiments of the present disclosure may have a bend radius of less than about 100 mm, less than about 50 mm, less than about 25 mm, or even less than about 5 mm, for example.

Additionally or alternatively to providing for the indication of translational displacement and/or angular rotation of the web, the scale may also be used to measure various parameters of the web or ambient environment surrounding the web. For example, as discussed in more detail below, the scale may be used to measure temperature and/or modulus of elasticity of the web, and/or may be used to measure web strain.

FIG. 1 is a flow diagram illustrating a process for aligning web pattern features using an integral scale on a flexible web in accordance with embodiments of the disclosure. In accordance with these embodiments, the scale features formed or otherwise disposed on the flexible web modulate 110 an energy field, such as light energy directed toward the web. For example, in one implementation, the scale features may comprise a series of discrete scale features arranged longitudinally on the web. The longitudinally arranged scale features are configured for energy modulation that can be measured to determine the longitudinal displacement. In another implementation, the scale features may comprise a first set of discrete scale features arranged longitudinally and another set of scale features arranged laterally. The longitudinal and lateral scale features are configured to modulate energy for determination of longitudinal and lateral displacement of the web and may also be used to determine the angular rotation of the web. The transducer converts 120 the modulated energy into an output signal that indicates the continuous translational and/or angular displacement of the web. For example, the output signal may comprise an analog output signal provides for continuous information of web displacement or position as opposed to web displacement or position information provided in discrete increments. By this approach, one or more degrees of freedom of the web can be measured. The analog output signal may provide continuous indication of the longitudinal displacement, the lateral displacement, and/or the angular rotation of the web. The web position and/or angular rotation may be determined 130 from the transducer signal. Using the web position information, the web is aligned 140 for deposition of web pattern features.

Various types of scale features may be used with compatible sensors to indicate continuous web displacement. The scale features may modulate electric field energy, may modulate magnetic field energy, or may modulate light, for example. Embodiments of the disclosure are described in terms of optical scale features and compatible photosensors, although any type of scale feature/sensor configuration that modulates an energy field to produce a signal indicating continuous web displacement may be used.

Figure 2A:
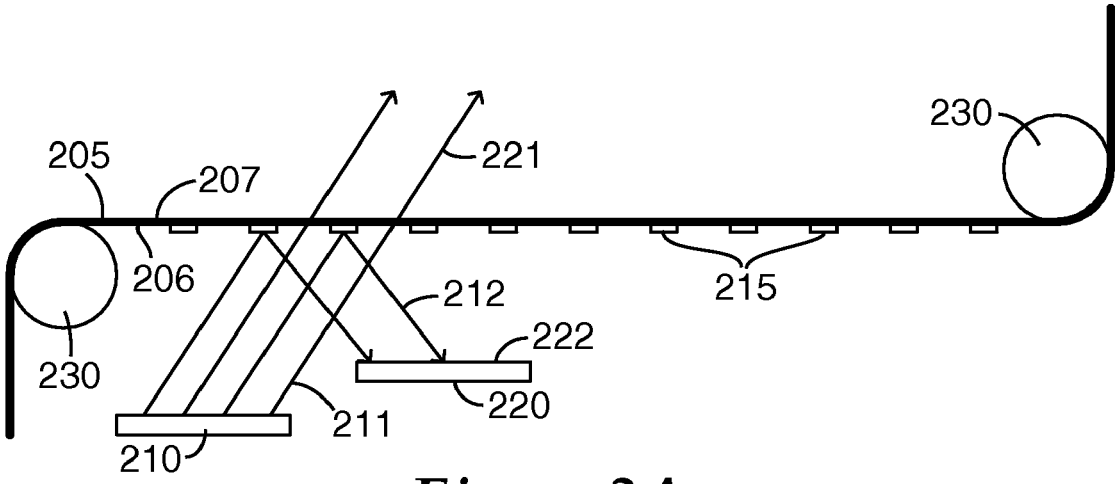
FIG. 2A illustrates a system for indicating web displacement operating in reflective mode in accordance with embodiments of the disclosure.
Figure 2B:
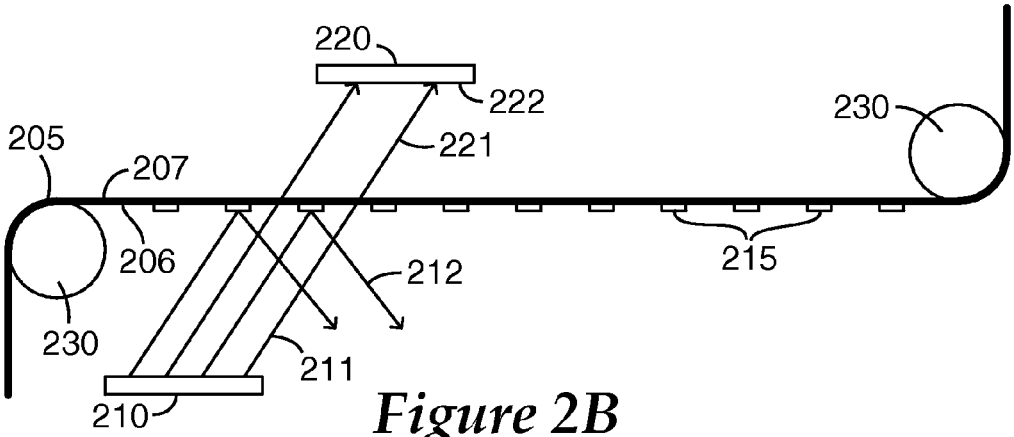
FIG. 2B illustrates a system for indicating web displacement operating in transmissive mode in accordance with embodiments of the disclosure.

FIGS. 2A-2D are diagrams of systems that use modulation of energy by scale features on a flexible web to indicate the translational or rotational displacement of the web and/or to determine web parameters derived from the displacement measurements. Principles of the disclosure are explained in terms of optical scale features used with compatible photosensors, although it will be appreciated that any other types of scale feature and sensor configurations that modulate and sense energy may alternatively be used. FIGS. 2A-2B illustrate optical systems used for indicating web displacement. The systems include a light source 210 that directs light 211 toward a moving, flexible web 205. A transport system including rollers 230 is used to move the web 205 while maintaining web tension and position to facilitate deposition of web pattern features. The web 205 is in motion relative to the fixed positions of the light source 210 and photosensor 220.

The system of FIG. 2A illustrates a system for indicating web displacement operating in reflective mode. In reflective mode, the light source 210, which may be a multi-source array, and one or more photosensors 220 are arranged near the same surface 206 of the web. The light source 210 directs light 211 toward a surface 206 of the web 205. A portion of the light is reflected by the optical scale features 215 toward the photosensor 220. The photosensor 220 senses the reflected light and generates an analog output signal that indicates a continuous web displacement. In this embodiment, the web 205 may or may not be transparent. In configurations where the web 205 is transparent, a portion of the light 221 may be transmitted through the web 205. It will be appreciated that if the web 205 is transparent, the scale features 215 may be arranged on either surface 206, 207 of the web 205, or on both surfaces.

FIG. 2B illustrates a system for indicating web displacement that operates in transmissive mode. In this configuration, the light source 210, and photosensors 220 are arranged on opposite surfaces 206, 207 of the web 205. The light source 210 directs light 211 toward a surface 206 of the web 205. A portion of the light 212 is reflected by the scale elements 215. Another portion of the light 221 passes through the transparent web 205 to the photosensor 220. The photosensor 220 senses the transmitted light 221 and generates an analog output signal that indicates web displacement.

Figure 3A:
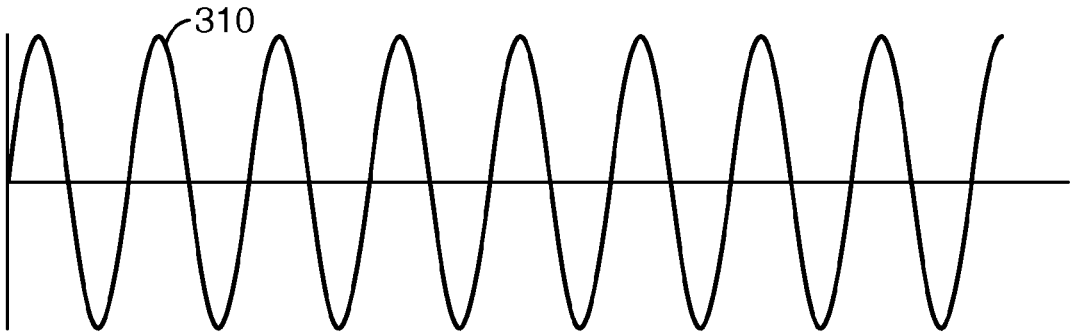
FIG. 3A is graph of light intensity at the surface of a photodetector, the light intensity modulated by scale features in accordance with embodiments of the disclosure.

The light intensity at the active surface 222 of the photosensor 220 for the systems of FIGS. 2A and 2B is illustrated by the light intensity graph 310 of FIG. 3A. The light intensity graph 310 is substantially sinusoidal having peaks at points of highest intensity and valleys at points of low intensity. The photosensor 220 detects the light at the active surface 222 and generates a sinusoidal analog output signal that tracks the light intensity at the active surface 222 of the photosensor 220.

Figure 2C:
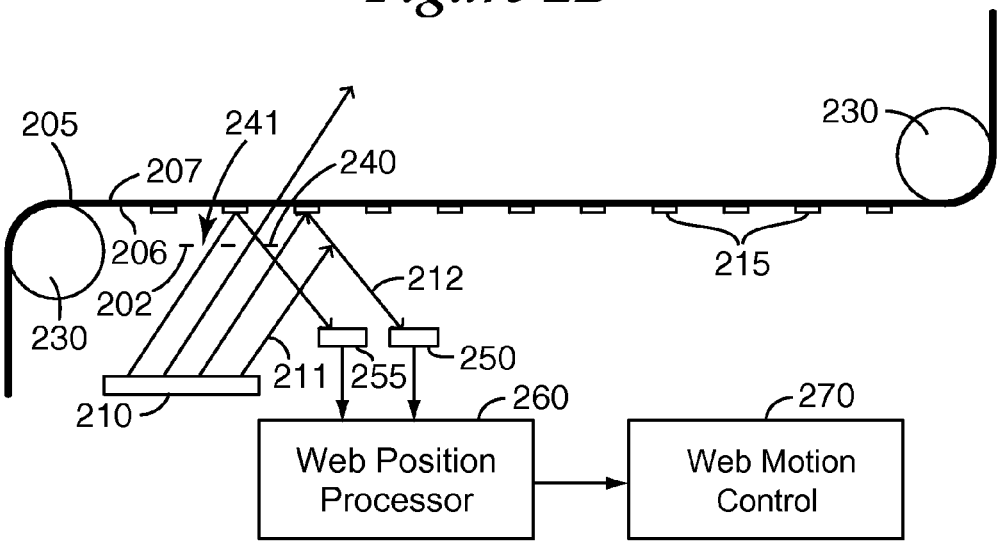
FIG. 2C illustrates a system for controlling web movement operating in reflective mode in accordance with embodiments of the disclosure.
Figure 2D:
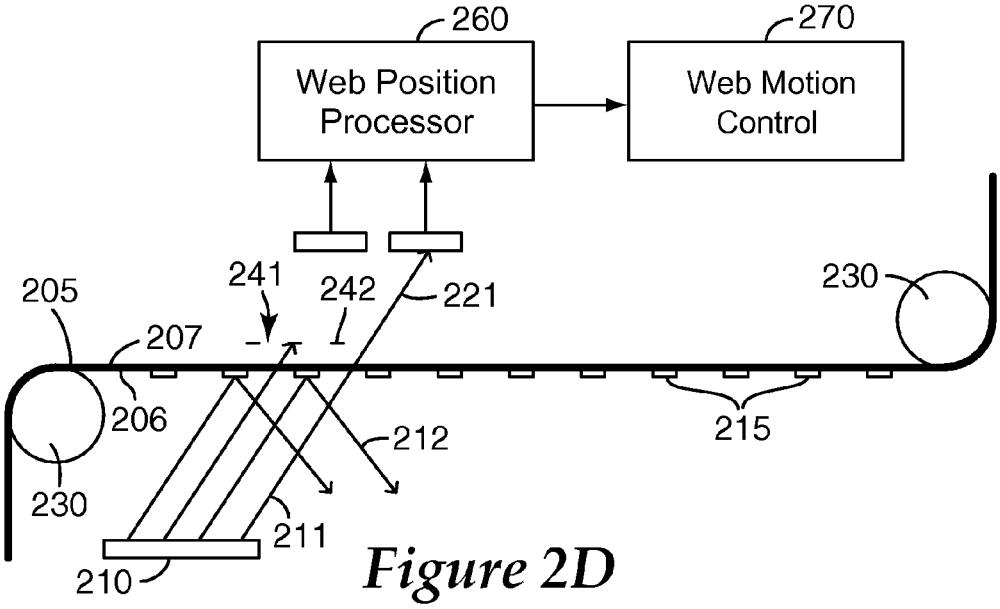
FIG. 2D illustrates a system for controlling web movement operating in transmissive mode in accordance with embodiments of the disclosure.

FIGS. 2C and 2D illustrate systems for controlling web position using web displacement indicated via reflective (FIG. 2C) and transmissive (FIG. 2D) modes. The components used to indicate web position in FIGS. 2C and 2D are similar to those of FIGS. 2A and 2B, respectively, except the systems of FIGS. 2C-2D each additionally include one or more scanning reticles 240 and multiple photosensors 250, 255. The web 205 is in motion relative to the fixed positions of the light source 210, scanning reticle 240 and photosensors 250, 255.

The scanning reticle 240 is oriented a short distance from the web 205 so that the reticle windows 241 allow a portion of the light directed toward the web 205 to pass through the reticle 240. Regions 242 of the reticle 240 between the windows 241 block a portion of the light.

Figure 6A:
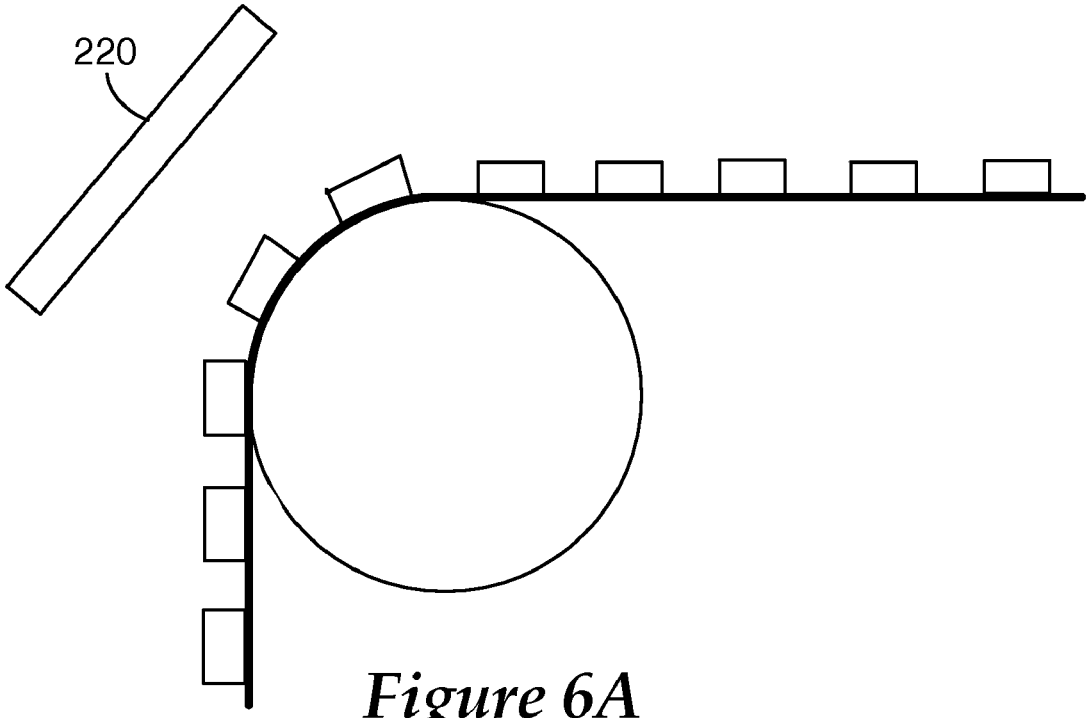
FIG. 6A illustrates a portion of a system for controlling web movement operating in reflective mode in accordance with embodiments of the disclosure.
Figure 6B:
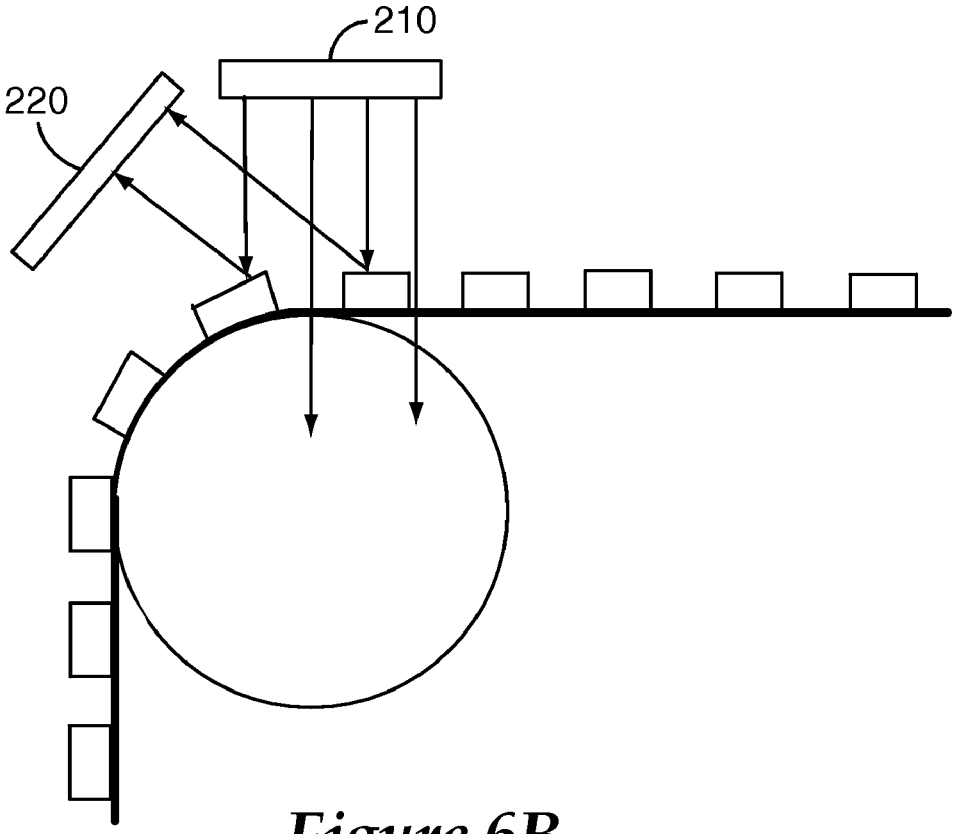
FIG. 6B illustrates a portion of a system for controlling web movement operating in reflective mode in accordance with embodiments of the disclosure.

In another embodiment, depicted in FIG. 6A, the one or more photosensor 220 is located "on the roll". The phrase "on the roll" as used herein is meant to refer to a location of the photosensor that is in proximity to one of rolls within the system and is configured to receive reflected light from one or more of the optical scale elements on the web when the portion of the web that they are on is in contact with the roll. Such an embodiment can offer an advantage by minimizing noise which may be associated with the signal being sensed by the photosensor. In embodiments where the sensor is "off the roll" (FIGS. 2A through 2D for example) the vibration of the web itself can increase noise of the reflected light. As seen in FIG. 6B, the light source in this exemplary embodiment can be located above the web. Although not shown herein, another exemplary embodiment could include the use of a transparent roll having a light source in the roll itself. Such an embodiment would function in the transmissive mode (as explained above).

Embodiments where the sensor is located off roll (such as those exemplified in FIGS. 2A through 2D) offer the advantage of an air gap between the light source and the web. In embodiments where the sensor is on roll, an air gap is not necessarily present. In such embodiments, changes can but need not, be made to the web or the roll in order to compensate for the air gap not being present.

Once such method for compensating for the air gap not being present includes altering the surface of the roll. Often times, but not always, the rolls are reflective in nature (for example, stainless steel). Therefore, the roll could be made to have a matte surface. By changing the surface of the roll from reflective to matte, for example, light rays that are interacting with an optical scale element (which is reflective) can more easily be distinguished from one which is interacting with the roll. Another method of altering the surface of the roll would be to make the roll a different color. In an embodiment, the roll could be made to have a dark color, thereby absorbing more light than a reflective roll (for example). Both of these exemplary methods could increase the contrast between two light rays (one interacting with an optical scale element and one interacting with the roll).

Another method of compensating for the air gap being gone is to create an air gap between the web and the roll. The air gap, if created, would function to refract the light that goes through the web and reflects off the roll. Because of the refractive index of air (versus the material that make up the web), the light that has been allowed through the web, then traveled through the air gap, then reflected off the roll, then traveled through the air gap again, and then traveled through the web again will have a different angle and (depending on the transmissivity of all of the involved components) a different intensity than the light which was reflected off the optical scale elements.

Figure 7A:
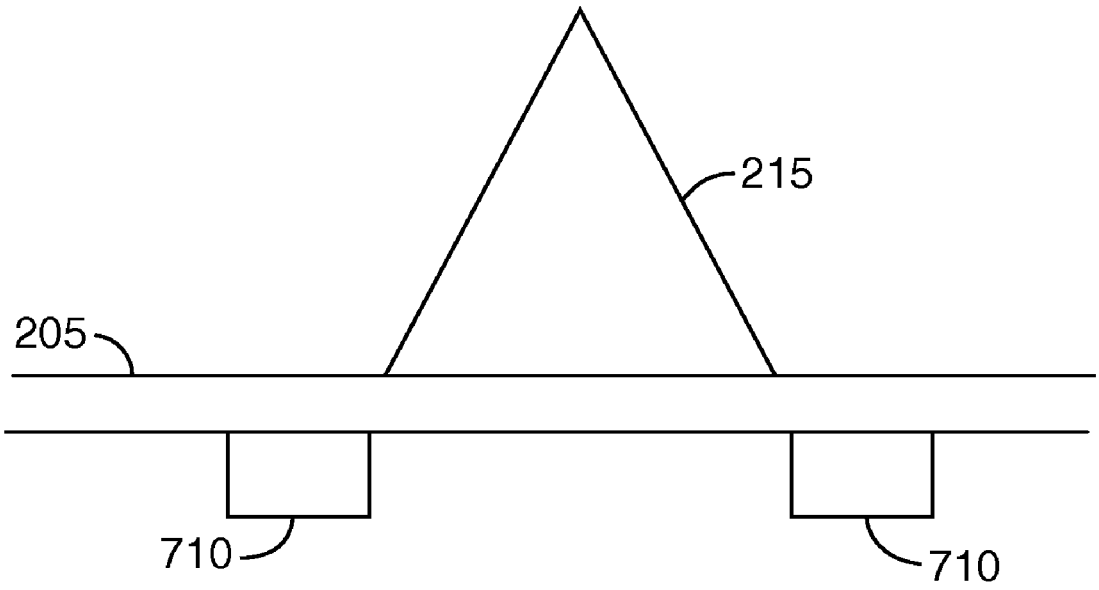
FIG. 7A illustrates scale features arranged longitudinally on one surface of a web and a second pattern on the back side of the web in accordance with embodiments of the disclosure.

An air gap between the roll and the back side of the web could be created by, for example, providing a structure on the back of the web to create and maintain a gap between the roll and the web. FIG. 7A shows one exemplary method of creating such a gap. In FIG. 7A, the web 205 includes the optical scale elements 215 as the other exemplified webs did, but also includes gap structures 715 which function to create an air gap between the roll and the web 205.

Figure 3B:
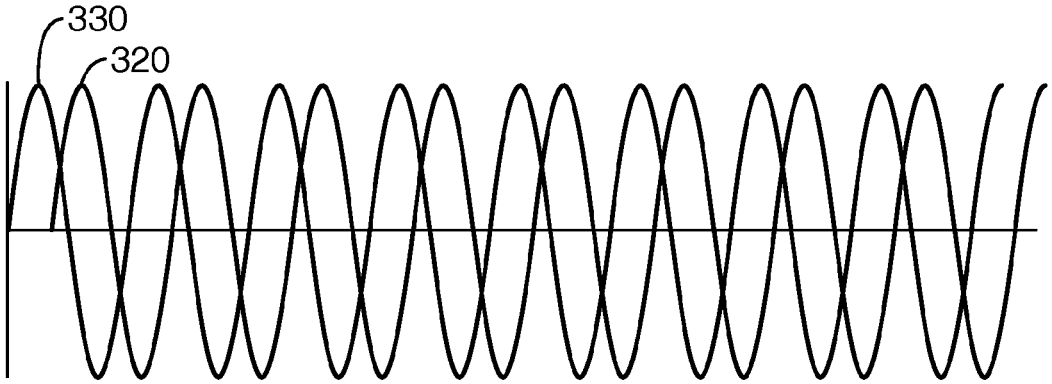
FIG. 3B illustrates graphs of light intensity at the surface of dual photodetectors, the light intensity modulated by scale features and a scanning reticle to achieve sinusoidal light intensities with a phase difference of 90° in accordance with embodiments of the disclosure.
Figure 7B:
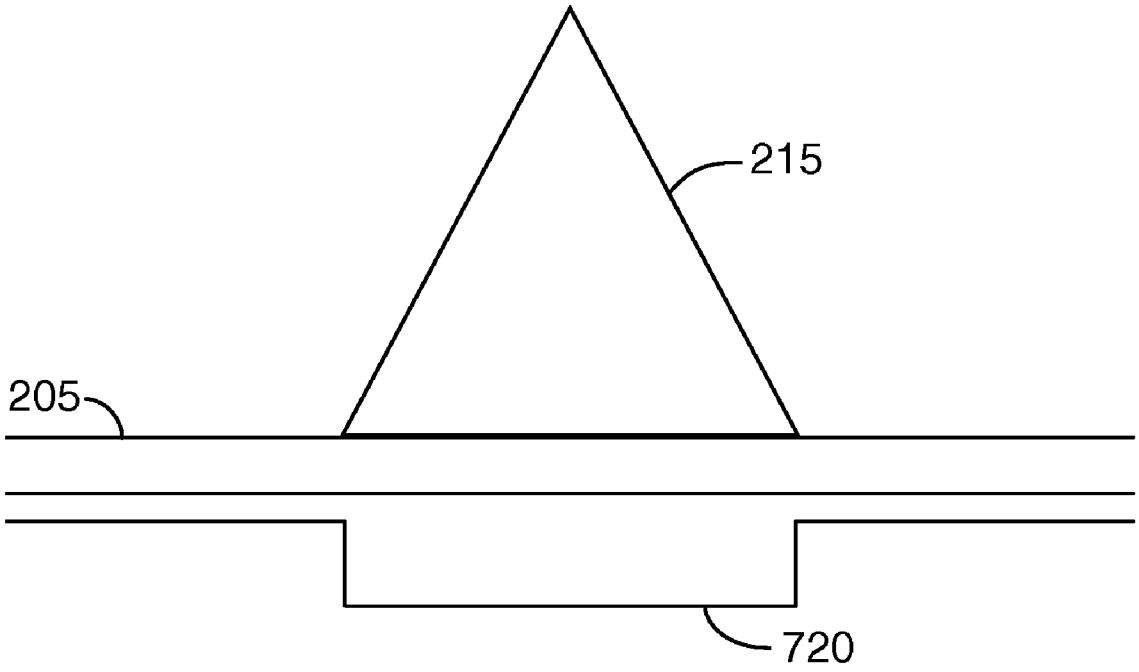
FIG. 7B illustrates scale features arranged longitudinally on one surface of a web and a second pattern on the back side of the web in accordance with embodiments of the disclosure, While the disclosure is amenable to various modifications and alternative forms, specifics thereof have been shown by way of example in the drawings and will be described in detail. It is to be understood, however, that the intention is not to limit the disclosure to the particular embodiments described. On the contrary, the intention is to cover all modifications, equivalents, and alternatives falling within the scope of the disclosure as defined by the appended claims.

FIG. 7B exemplifies another method of creating an air gap between the web and the roll. This method modifies the roll instead of the web. As seen in FIG. 7B, the roll includes recessed portions 720 that function to provide a gap between the web and the roll at the location of the optical scale element 215. As seen in FIGS. 2A through 2D, the photosensors 250, 255 sense light present at the surface of the sensors 250, 255 and generate independent output signals. Through the use of the scanning reticle 240, the light intensity at the photosensors corresponds to the two symmetrical sinusoidal signals 320, 330 phase shifted by 90° illustrated in FIG. 3B. Output signals tracking the light intensity at the surface of the photosensors 250, 255 are produced by the photosensors 250, 255 to indicate web position.

The output signals 320, 330 generated by the photosensors 250, 255 are analyzed by the web position processor 260 to determine the position of the web. Using the phase shifted signals 320, 330 the web position processor 260 may determine both the position and direction of motion of the web relative to the photosensors. This information is used by the web motion controller 270 to control web movement.

In some embodiments, multiple light sources and/or multiple photosensors may be used for sensing translational and/or angular displacement of the web and/or for determining web parameters. Systems using multiple sensor combinations provide signal redundancy, providing a more robust system. In some embodiments, energy modulated by more than one scale feature, for example about 3 to 20 features, is used to produce the sensor output signal. The output signal may average or otherwise combine the energy modulated by the multiple features. In this configuration, if a single feature, or even several features, are damaged or obscured by dirt, the averaged output signal is minimally impacted.

Figure 2E:
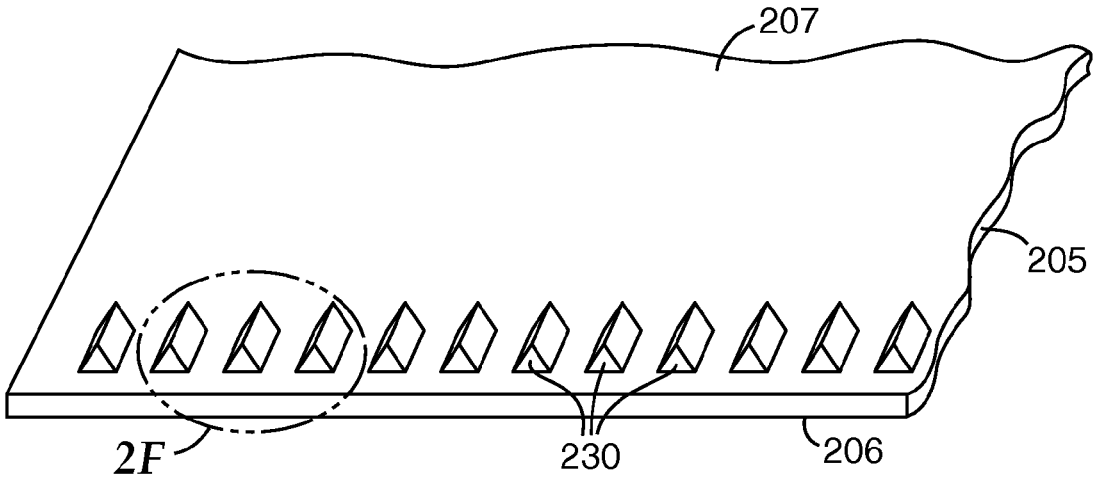
FIGS. 2E and 2F illustrate scale features arranged longitudinally on a web in accordance with embodiments of the disclosure.
Figure 2F:
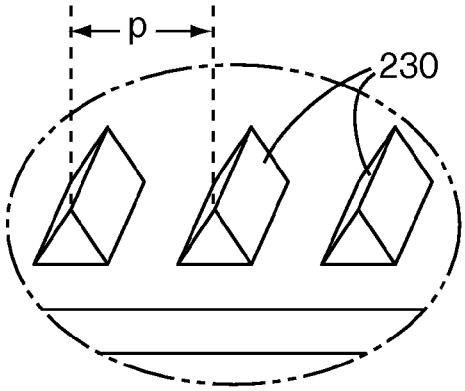
Figure 2H:
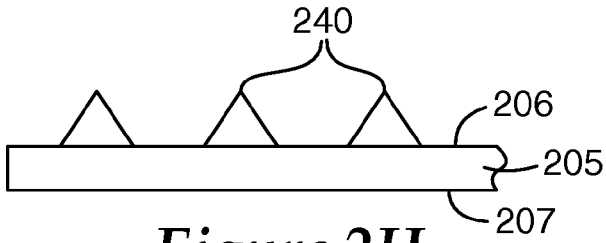
FIGS. 2G and 2H illustrate scale features arranged laterally on a web in accordance with embodiments of the disclosure.
Figure 2G:
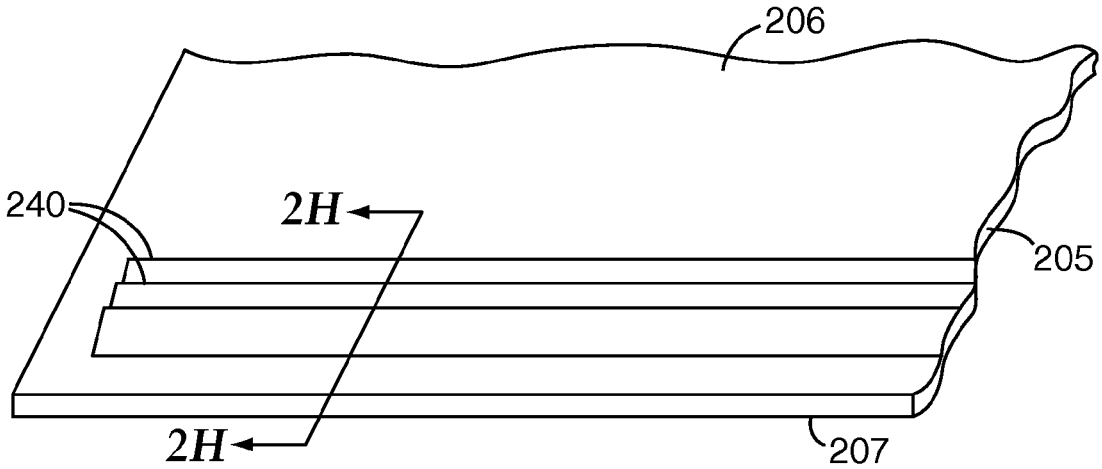

The scale features may include longitudinally arranged features, laterally arranged features or a combination of both longitudinally and laterally arranged features. As illustrated in FIGS. 2E and 2F, in one embodiment, a set of scale features 230 may be arranged for longitudinal displacement measurement on top 207, bottom 206 or on both surfaces 206, 207 of the web 205. A set of light source and sensor components, as illustrated in FIGS. 2A-2D, are configured to detect the energy modulated by the longitudinal scale features 230 and to generate signals that indicate longitudinal displacement of the web 205 and/or may be used to measure other web parameters. In one embodiment, shown in FIGS. 2G and 2H, a set of scale features 240 may be arranged for lateral displacement measurement on the top 207, bottom 206 or on both surfaces 206, 207 of the web 205. A set of light source and sensor components are configured to detect the energy modulated by the lateral scale features and to generate signals that indicate lateral displacement of the web and/or may be used to measure other web parameters.

The scale features illustrated in FIGS. 2E-2H are linear triangular prisms, which may have a prism pitch and distance between prisms ranging down to about a few microns. Convenient dimensions for this type of prism include a prism pitch of about 40 μm and a distance between prisms of about 20 μm.

Figure 2I:
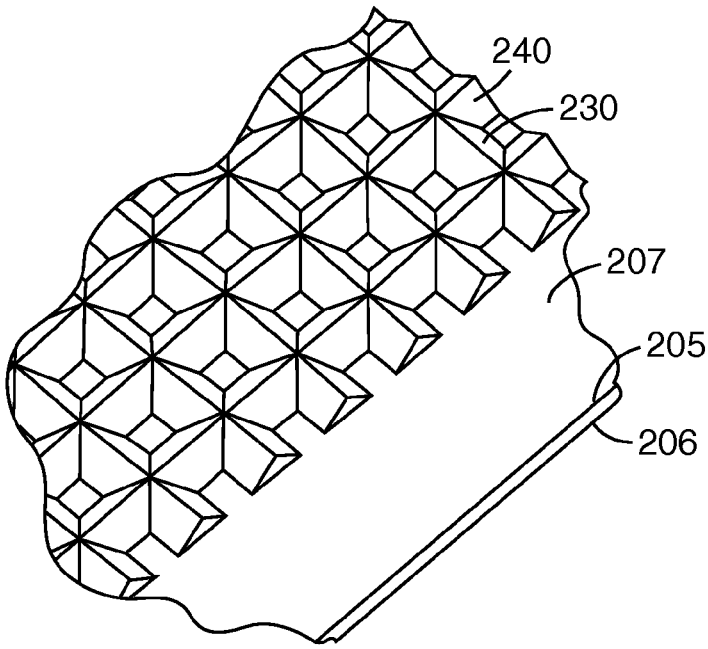
FIG. 2I illustrates scale features arranged in a checkerboard pattern for both longitudinal and lateral displacement measurement in accordance with embodiments of the disclosure.

The use of both longitudinal and lateral scale features and compatible source/sensor combinations allows for indication of longitudinal and lateral web displacement as well as angular displacement. FIG. 2I illustrates a web with both longitudinal 230 and lateral 240 scale features disposed on the top surface 207 of the web 205. The longitudinal and lateral scale features 230, 240 may be disposed on opposite sides of the web 205 or on the same side of the web. If the longitudinal and lateral features 230, 240 are disposed on the same side of the web 205, they may form the checkerboard pattern as illustrated in FIG. 2I. The longitudinal and lateral features may be connected as illustrated in FIG. 2I, or may comprise an alternating pattern of discrete, disconnected prisms. In some embodiments, the checkerboard pattern may include regions of multiple longitudinal features alternating with regions of multiple lateral features.

Figure 4A:
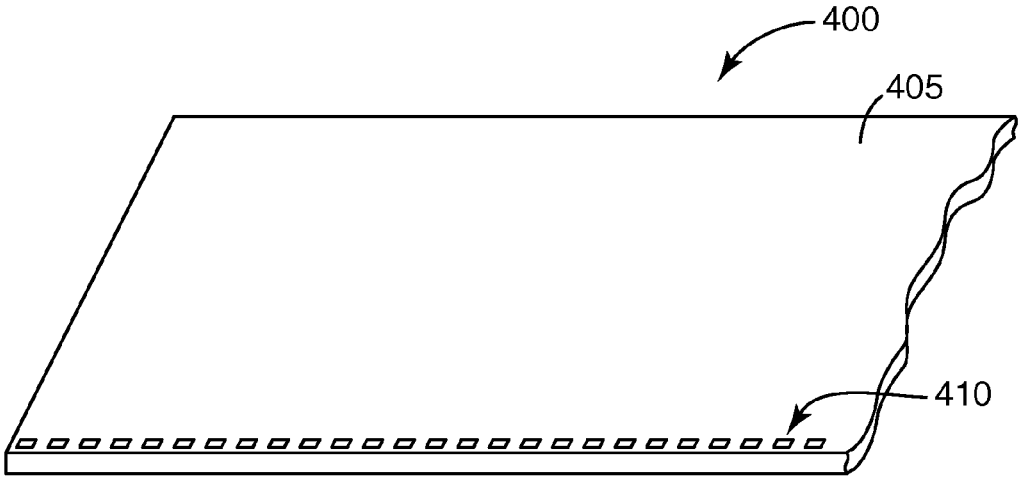
FIG. 4A is a diagram of a roll good comprising a web having integral scale features in accordance with embodiments of the disclosure.

As previously discussed, the flexible, elongated web having an integral scale is particularly advantageous for use in roll-to-roll manufacturing processes. For example, the integral scale may be used in positioning the web for manufacturing processes that require alignment during successive manufacturing steps, such as in the formation of layered electronic devices. FIG. 4A illustrates a web 405 having an integral scale 410 formed on the web which may be sold as a roll good 400. The web/scale roll good product 400 may be used in manufacturing processes with the scale 410 providing position information to facilitate formation of pattern features on the web 405.

Figure 4B:
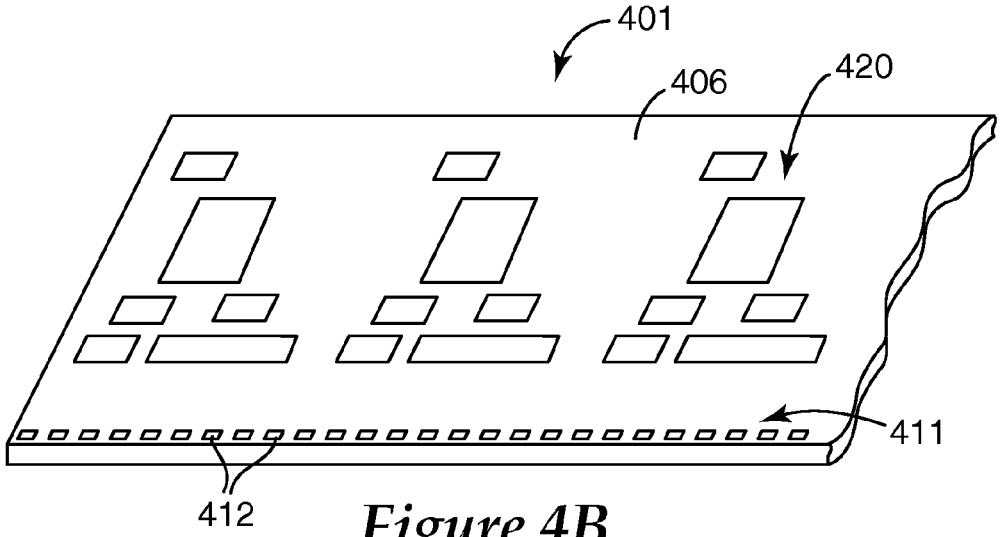
FIG. 4B is a diagram of a roll good comprising a web having an integral scale and also having pattern features deposited on the web in accordance with embodiments of the disclosure.

Alternatively, as illustrated in FIG. 4B, a roll good 401 may comprise the flexible web 406 having an integral scale 411 formed concurrently along with a first layer of web pattern features 420. This configuration is particularly helpful in compensating for dimensional changes in the web 406 during successive layer depositions. For example, polymer webs may be prone to shrinkage or expansion due to thermal processing, and/or to absorption or desorption of water or other solvents, making layer-to-layer alignment difficult. When the scale features 411 and the first layer of web pattern features are concurrently formed, alignment of subsequent depositions using the integral scale 411 provides automatic compensation for changes in web strain that commonly occur in web processing applications. As web strain is increased (i.e. the web is stretched more) the scale is stretched along with the first layer of web pattern features formed on the web. When the pattern features 420 and scale features 412 experience the same dimensional changes during formation it allows the scale features 412 to more accurately track the position of pattern features 420 deposited on the web 406.

Figure 4C:
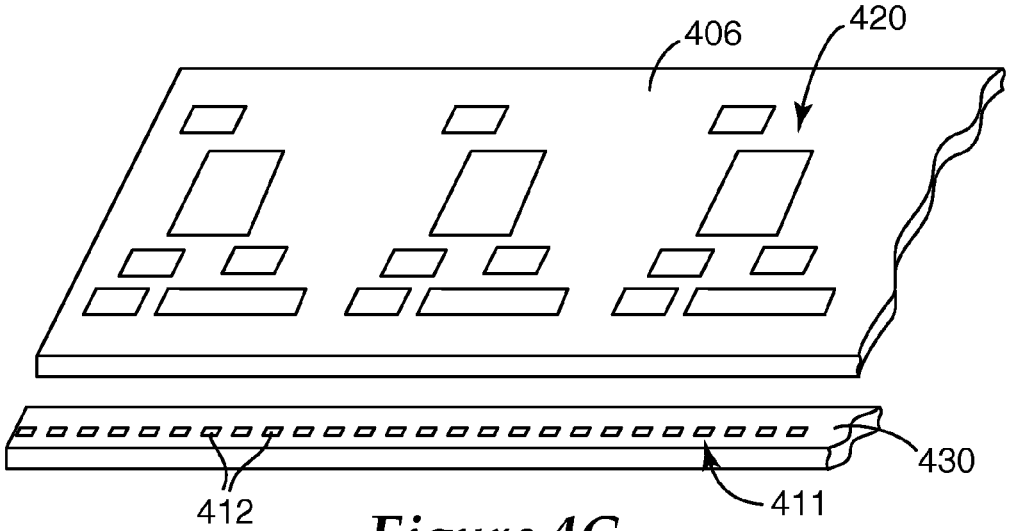
FIG. 4C is a diagram of a scale which has been separated from a web in accordance with embodiments of the disclosure.

In some embodiments, illustrated in FIG. 4C, after the manufacturing process is complete, the scale portion 430 may be separated from the web 406 and sold as a roll good. The scale portion 430 may be attached to a different web and used for web positioning as described herein. An adhesive may be provided on a surface of the scale portion 430 to facilitate attachment of the scale to a web, substrate or other workpiece as desired.

Scales formed on flexible material are particularly useful when they are attached to a base substrate. One consideration encountered when attaching scales to a machine or other substrate is the difference in the coefficient of thermal expansion (CTE) between the substrate and the scale. For example, if a very rigid scale is used, the scale will expand at a different rate than the substrate, so the scale changes a different amount by $(CTE_{scale}-CTE_{substrate})$*deltaT*scale length. If the scale expands less than the substrate, it is relatively easy to manage, as the scale is in tension, and will always follow a straight line. However, if the scale expands more than the substrate, the scale will be in compression, and additional forces are generated that tend to buckle the scale (i.e. the scale tends to ripple out of plane). The compressive force generated is λ(modulus)*A(area)*strain.

Flexible scales formed in accordance with various embodiments of the disclosure have CTE's about 5 times higher than the typically used steel scales, but have modulus of elasticity about 300 times less that steel scales. The net force is about 60 times smaller. Thus, a flexible scale described herein may be bonded to a substrate without significant buckling, allowing the scale to more closely track the position of the substrate.

By using a flexible scale, such as a plastic or polymer scale having rectangular array of pyramids which allow x/y readout, it is possible to make flexible scale much larger than scales currently available. For example, it is possible to make scales that are miles long with widths of 60 inches or more.

In accordance with various embodiments, the scale features may comprise prisms configured to reflect light via total internal reflection. Total internal reflection (TIR) occurs when the incident angle of light is greater than or equal to a critical angle $\theta_c$. For incident angles greater than $\theta_c$, all incoming energy is reflected.

Figure 5A:
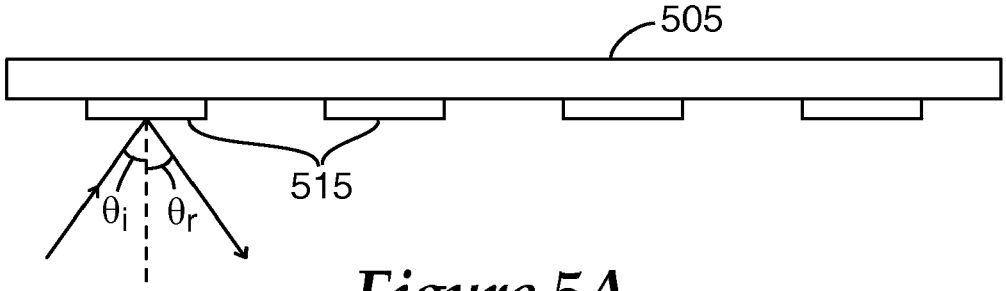
FIG. 5A illustrates the use of total internal reflection for indicating web displacement in accordance with embodiments of the disclosure.

FIG. 5A shows a scale comprising TIR features 515 on a web 505 and illustrates the principle of total internal reflection as it is used in accordance with various embodiments. Light generated by a light source is directed toward the web 505 having an integral scale comprising TIR scale features 515. If the angle, $\theta_i$, of the light 511 directed toward the TIR scale features 515 is greater than or equal to the critical angle $\theta_c$, then the light is reflected at angle $\theta_r$.

Figure 5B:
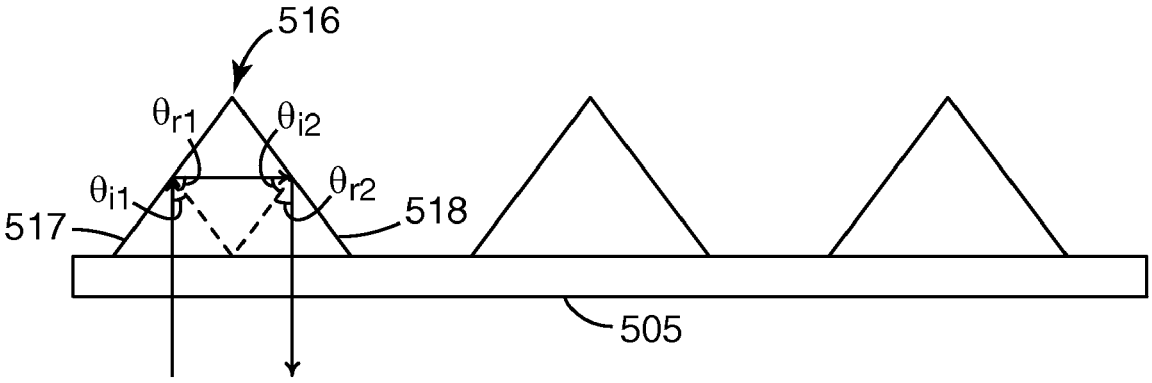
FIG. 5B illustrates scale features comprising right regular prisms configured to provide total internal reflection of light to indicate web displacement in accordance with embodiments of the disclosure.

The TIR scale features may be formed in any shape or configuration that provides reflection via TIR. In some embodiments, the TIR scale features may comprise right regular prisms, as illustrated in FIG. 5B. In this embodiment, if the angle, $\theta_{i1}$, of the light incident light incident on the left face 517 of the TIR scale feature 516 is greater than $\theta_c$, the light is totally internally reflected to the right prism face 518 with incident angle $\theta_{i2}$. At the right prism face 518, the light is again totally internally reflected at angle $\theta_{r2}$ and exits the prism 516 parallel to the incident light. Reflection via TIR conveniently reflects nearly all of the light incident on the face of the TIR scale features without deterioration that may occur with metallized surfaces that are typically used for reflective scales.

The use of TIR scale features may not be practical for all applications, for example when the web is opaque. In one embodiment the scale features comprise raised features that are replicated on the web. The raised features may be coated with a reflective material. In other embodiments, the deposition of the scale features may comprise printing features, such as via ink jet, on the web in a prescribed manner.

As previously discussed, scale features on the web may be used to modulate energy for indicating the translational and/or rotational displacement of the web. Additionally, or alternatively, the scale features may be employed in the measurement of various web parameters. In various embodiments, parameters which depend on dimensional changes of the web, such as temperature, strain, and/or modulus of elasticity, may be measured using the scale features.

In one application, the scale features may be used to measure a change in web temperature. A change in web temperature of δT causes a corresponding dimensional change of $\delta L_T$. The scale features and sensor circuitry can be used to measure the dimensional change, $\delta L_T$. The change in temperature of the web, δT, may be derived from the measured dimensional change.

The scale features may be used to measure web strain, the amount of deformation caused by force that stretches the web. For example, considering only longitudinal strain, as the web having an initial length of L is stretched along its longitudinal (x) axis, the web length changes by δL, from a first length, $L_1$, to a second length, $L_2$. The linear strain, $\epsilon_x$, of the longitudinally stretched web is expressed by $\epsilon_x=\delta L_0$. The strain along the x axis at any point of the web may be expressed as the differential of the displacement in the x direction at any point along the axis, $\epsilon_x=\partial u_x/\partial x$. The angular or shear strain takes into account deformation along both the longitudinal (x) axis and the lateral (y) axis. The angular or shear strain at any point of a web, $$\gamma_{xy} = \frac{\partial u_x}{\partial y} + \frac{\partial u_y}{\partial x}.$$

Scale features arranged in both the longitudinal (x) and lateral (y) directions can be used, along with compatible energy source/sensor combinations, to measure longitudinal and lateral deformations of the web. These deformations may be used to calculate linear strain along the x and y axis as well as angular or shear strain.

In one application, measured deformation of the web may be used to calculate the modulus of elasticity. The modulus may be calculated as λ=stress/strain. Thus, using a known force and measuring web strain as described above, the modulus of elasticity of the web may be determined.

The embodiments described herein involve webs having integral scale features that allow continuous tracking of the translational and angular displacement of a web, and/or allow measurement of various web parameters. The scale features may be formed in or on the web by various techniques. For example, the scale features may be deposited or otherwise formed on the web such as by a cast and cure process. Alternatively, the features may be made in the web, such as by scribing, ablating, printing or other techniques.

In some embodiments, the scale features may be erased and rewritten. For example, in one application, the scale features may be erased or written in magnetic media by selectively exposing portions of the media to a magnetic field. In another application, the scale features may be erased and/or written in optical media, such as by using a laser to heat portions of the scale to active an organic dye. In yet another embodiment, the scale features may be erased and/or written by modifying the optical properties of the scale features. For example, the index of refraction of an optical material may be modified through chemical processing to erase or write the scale features on the substrate.

Various techniques may be used to apply the scale features to webs such as webs made of paper, fiber, woven or non-woven material. The webs may comprise polyester, polycarbonate, PET, or other polymeric webs. Techniques for formation of TIR scale features are described in commonly owned US patent application identified by Attorney Docket No. 63013US002 filed concurrently with the present application and incorporated herein by reference.

The foregoing description of the various embodiments of the disclosure has been presented for the purposes of illustration and description. It is not intended to be exhaustive or to limit the disclosure to the precise form disclosed. Many modifications and variations are possible in light of the above teaching. It is intended that the scope of the disclosure be limited not by this detailed description, but rather by the claims appended hereto.

What is claimed is:

1. A method for indicating web displacement, comprising:
moving an elongated, flexible web having a plurality of discrete scale features disposed thereon and wherein the plurality of discrete scale features comprise optical prisms configured to reflect light via total internal reflection;
modulating light using the plurality of discrete scale features;
converting the modulated light into a signal that provides indication of continuous web displacement using a web position processor.

2. The method of claim 1, further comprising determining a position of the web based on the signal.

3. The method of claim 1, wherein:
the web comprises a transparent web;
modulating the light comprises transmitting a portion of the light through the transparent web; and
further comprising determining the displacement of the web based on the transmitted light.

4. The method of claim 1, wherein:
modulating the light comprises reflecting a portion of the light; and
further comprising determining the displacement of the web based on the reflected light.

5. The method of claim 1, wherein:
the web comprises a transparent web; and
modulating the light comprises:
reflecting a portion of the light using the optical scale features; and
transmitting a portion of the light through the web.

6. The method of claim 1, wherein modulating the light further comprises modulating the light using one or more reticles.

7. The method of claim 1, wherein the web comprises a transparent polymer.

8. The method of claim 1, wherein a bend radius of the web is less than about 100 mm.

9. The method of claim 1, wherein determining the displacement of the web comprises determining longitudinal displacement.

10. The method of claim 1, wherein determining the displacement of the web comprises determining lateral displacement.

11. The method of claim 1, wherein determining the displacement of the web comprises determining angular rotation.

12. The method of claim 1, wherein:
determining the displacement of the web comprises measuring web deformation; and
further comprising determining temperature based on the web deformation.

13. The method of claim 1, wherein:
determining the displacement of the web comprises measuring web deformation; and
further comprising determining web strain based on the web deformation.

14. The method of claim 1, wherein:
determining the displacement of the web comprises measuring web deformation; and
further comprising determining a modulus of elasticity of the web based on the web deformation.

15. A system for indicating web displacement, comprising:
an elongated, flexible web having an integral scale disposed thereon, the scale comprising a plurality of discrete scale features comprising optical prisms configured to reflect light via total internal reflection and configured to modulate light directed towards the web;
a transducer configured to sense the light modulated by the plurality of discrete scale features and to generate a signal indicating continuous web displacement based on the modulated light; and
a transport mechanism configured to provide relative movement between the web and the transducer.

16. The system of claim 15, further comprising a web position processor configured to determine a position of the web based on the signal.

17. The system of claim 15, wherein the elongated, flexible web comprises a transparent web.

18. The system of claim 15, wherein the elongated, flexible web comprises polymer, paper, woven or non-woven materials.

19. The system of claim 15, wherein:
the web comprises a moving web; and
further comprising one or more reticles configured to further modulate the light.

20. The system of claim 15, wherein:
the scale is configured to modulate the light by transmitting a portion of the light; and
the transducer is configured to detect the transmitted light and to generate the signal based on the transmitted light.

21. The system of claim 15, wherein:
the scale is configured to modulate the light by reflecting a portion of the light; and
the transducer is configured to detect the reflected light and to generate the signal based on the reflected light.

22. The system of claim 15, wherein the web has web pattern features disposed thereon.

23. The system of claim 15, wherein a bend radius of the web is less than about 100 mm.

24. The system of claim 15, wherein the displacement comprises a longitudinal displacement of the web.

25. The system of claim 15, wherein the displacement comprises a lateral displacement.

26. The system of claim 15, wherein the displacement comprises an angular rotation of the web.

27. An apparatus comprising a flexible, elongated web having an integral scale, the scale comprising a pattern of scale features disposed on the web, the scale features comprising optical prisms configured to reflect light via the total internal reflection and the scale features modulating light directed toward the web, the modulated light indicative of a continuous displacement of the web.

28. The apparatus of claim 27, further comprising a pattern of web features disposed on the web.

29. The apparatus of claim 27, wherein the bend radius of the web is less than about 100 mm.

* * * * *

UNITED STATES PATENT AND TRADEMARK OFFICE

CERTIFICATE OF CORRECTION

PATENT NO. : 8,405,831 B2
APPLICATION NO. : 12/664523
DATED : March 26, 2013
INVENTOR(S) : Daniel Harold Carlson It is certified that error appears in the above-identified patent and that said Letters Patent is hereby corrected as shown below:

In the Specification:

Column 10,
Line 45, delete "$\varepsilon_x = \delta L_0$." and insert -- $\varepsilon_x = \delta L/L_0$. --, therefor.

Signed and Sealed this
Second Day of July, 2013

Teresa Stanek Rea
*Acting Director of the United States Patent and Trademark Office*